US005794865A

United States Patent [19]

Didion et al.

[11] Patent Number: 5,794,865

[45] Date of Patent: Aug. 18, 1998

[54] ROTARY CRUSHER/RECLAIMER FOR RECLAIMING AND RECLASSIFYING SAND AND RELATED AGGREGATES FROM LUMP MATERIALS

[75] Inventors: Charles J. Didion; Michael S. Didion, both of St. Charles, Mo.

[73] Assignee: Didion Manufacturing Company, St. Peters, Mo.

[21] Appl. No.: 506,815

[22] Filed: Jul. 25, 1995

[51] Int. Cl.[6] ..... B02C 19/12

[52] U.S. Cl. ..... 241/74; 164/404; 241/81; 241/91; 241/251; 241/261.1; 241/299; 241/DIG. 10

[58] Field of Search ..... 241/74, 91, 97, 241/80, 251, 252, DIG. 10, 79.3, 299, 261.1, 81; 164/5, 404

[56] References Cited

U.S. PATENT DOCUMENTS

| | | | |
|---|---|---|---|
| 677,691 | 7/1901 | Packer . | |
| 788,675 | 2/1905 | Rissmuller | 241/79.3 X |
| 1,736,394 | 11/1929 | Dierker . | |
| 2,050,458 | 8/1936 | Ovestrud et al. . | |
| 2,523,258 | 9/1950 | Ransohoff . | |
| 3,862,719 | 1/1975 | Muller . | |
| 3,958,764 | 5/1976 | Carpenter, Jr. et al. . | |
| 3,998,262 | 12/1976 | Didion . | |
| 4,154,290 | 5/1979 | Weststrate et al. . | |
| 4,674,691 | 6/1987 | Didion . | |
| 4,688,727 | 8/1987 | Sijsling | 245/261.1 X |
| 4,981,581 | 1/1991 | Didion . | |
| 5,016,827 | 5/1991 | Didion . | |
| 5,095,968 | 3/1992 | Didion . | |
| 5,267,603 | 12/1993 | Didion . | |

FOREIGN PATENT DOCUMENTS

| | | |
|---|---|---|
| 1220976 | 7/1966 | Germany . |
| 807711 | 1/1959 | United Kingdom . |

*Primary Examiner*—Mark Rosenbaum
*Attorney, Agent, or Firm*—Paul M. Denk

[57] ABSTRACT

The present invention relates to a rotary lump crusher/reclaiming drum for reclaiming lump materials such as aggregates, chemically-bonded sand lumps, dross, ferrous and non-ferrous scrap and slag. The rotary drum has an outer cylinder concentric with an inner cylinder both of which rotate simultaneously, the latter containing treatment compartments to reduce the lumps to smaller pieces which are in turn reduced to reclassifiable particulate matter in preparation for resuage.

5 Claims, 1 Drawing Sheet

ROTARY CRUSHER/RECLAIMER FOR RECLAIMING AND RECLASSIFYING SAND AND RELATED AGGREGATES FROM LUMP MATERIALS

BACKGROUND OF THE INVENTION

This invention relates to a rotary lump crusher/reclaimer for reclaiming and reclassifying lump materials such as aggregates, chemically-bonded sand lumps, dross, ferrous and non-ferrous scrap and slag.

There are a variety of apparatuses upon the market and in use that are applied for reducing lump material to a usable consistency. For instance lumps of sand that are generally chemically bonded together just after being broken from the mold or casted part used in the casting industry can be reduced to a granular texture for its immediate reuse in the formation of a mold for further casting.

There are a variety of apparatuses available for aiding in the separation of embedded core and cling sand that holds onto and remains in a casting after it is molded. These devices eliminate the need for a laborer to spend excessive hours cleaning the casting by hand. Such devices are readily shown in our earlier U.S. patents, for example, U.S. Pat. No. 3,998,262; No. 4,674,691; No. 4,981,581, No. 5,016,827; No. 5,095,968; and, No. 5,267,603. These patents disclose casting shake out units used to remove casting sand from a formed casting by tumbling the casting. In another embodiment, sand is removed from castings by abrasive members that also aid in the deburring of the casting. All these units as disclosed in the patents operate very successfully to clean and deburr castings. They have saved foundries many hours of labor that were previously required in the processing of fresh castings and have been extensively commercially accepted. Although our prior patents provide a means for separating cling sand from castings, there is also a further need for reclaiming lump material as described above. Other of our patent embodiments do take sand and reclassify the same, after its processing, following the green sand's use in forming of a mold during casting. In addition, means are provided for reclaiming lump material, i.e. lump material of sand, for further grading, to be used in preparation for reuse in the casting of metal parts.

SUMMARY OF THE INVENTION

A principal object of this invention is to provide a rotary lump crusher/reclaimer to reclaim lump materials, and classify its granular material.

A further object of this invention is to provide means for automatically separating tramp metal and debris from the grannular material that was used in the casting of metal products.

A further object of this invention is to provide means for recirculating any lumps of the mold sand that failed to pass through the reclaiming screen, and further processes the lumps of sand down to a granular size for reuse for sand mold and casting purposes.

These and other objects will become apparent to those skilled in the art upon a review of the following disclosure in light of the accompanying drawing.

In accordance with the invention, a rotary media drum is provided which reduces lump material into particulate material suitable for reuse in industrial processes. The drum includes an inner cylinder and concentric therewith, an outer cylinder which at one end extends beyond the inner cylinder to form an intake compartment of larger diameter to receive the lump material. A laser aligned base means is provided which incorporates a drive means supporting the drum and driving the drum, which is substantially horizontally disposed, in rotation. An intake compartment is provided to receive the lump material which intake compartment has a diameter as large or larger than the remainder of the outer cylinder. The diameter of the intake compartment is at least ten percent (10%) larger than the diameter of the inner cylinder. The intake compartment also contains high profile segmented helical flights which advance the lump material through the intake compartment to a first compartment in the inner cylinder. The advantage of the intake compartment having a larger diameter than the inner cylinder is it provides metering of the lump material into the first compartment to prevent surges of lump material from being passed to the first compartment. The first compartment of the inner cylinder contains means for breaking the lump material into smaller pieces. The preferred means for breaking the lump material into smaller pieces is a crushing and grading means. The first compartment preferably also contains in a first segment means to advance the lump material obtained from the intake compartment into the crushing means in a second segment of the first compartment. The crushing and grinding means advances the smaller pieces obtained in the first compartment to an attrition chamber. The attrition chamber has at least a partially perforated cylinder wall where high tumbling action further reduces the size of the pieces to particulate matter so at least a portion of the material passes through the perforations. Any material not passing through the perforations leaves the attrition chamber through an exit for debris. In addition, a conveying vane is provided intermediate the inner and outer cylinder for movement longitudinally of any particulate matter deposited therein to a screen for further finer classification of the particles. Any matter remaining on the screen is recycled to the intake compartment. The apparatus of the present invention is suitable for reducing the size of lump material to particulate matter of a predetermined size.

The present invention utilizes a rotary lump crusher/sand reclaiming drum for reclaiming lump materials. As has been shown in the prior art, a rotary media drum has been used for reclaiming core sand from metal castings. However, the present invention extends the use of the rotary media drum for processing a variety of lump sand materials including aggregates, chemically bonded sand lumps, dross, ferrous and non-ferrous scrap, and slag. Conventionally, material entering a rotary media drum is fed into one end of the drum by use of a conveyor, shovels, a load hopper, a vibratory conveyor or any desirable means for placing a large amount of material into the entry of the rotary-sand lump processing drum. It was found that the lump material described heretofore, when entering the drum in large quantities, tended to clump together resulting in surges when the material reached the first compartment in the inner cylinder which contains means for breaking the lump material into smaller pieces. Through the addition of an extension of the outer cylinder beyond the inner cylinder to form an intake compartment of larger diameter than heretofore, the material to be passed through it may be placed into the intake compartment in batch quantities and will distribute itself in such a manner as to prevent surges of lump material from cumulatively reaching the first compartment. The intake compartment has high profile segmented helical flights to advance the lump material from the intake compartment into the first compartment. The high profile segmented helical flights allow the clumps of lump material to separate sufficiently to provide a more uniform flow of material into the first compartment.

The first compartment of the inner cylinder contains a means for breaking up and separating of the lump material into small pieces. The means for breaking the lump material into smaller pieces comprises blades or spikes or the like protruding inwardly from the inside of the inner cylinder. As the material strikes these blades or spikes, the lumps are reduced in size and provide pieces of material suitable for further treatment and for reducing the size of the pieces into particulate type matter. Another means suitable for breaking the lumps is a crushing means located within the apparatus. In a preferred embodiment, a heavy crushing means is disposed for rotation within the first compartment through its pivotal mounting to a flexible suspension means. The suspension means holds the crushing means at one end and the crusing means, which is arranged generally longitudinally of the apparatus, revolves within the appartus within its bearing support so that lumps which are gradually fed and delivered to this regioun are substantially broken down through pressure, weight and shock when eventually forced under the crushing means to subject the material to the enormous weight of the crushing means. Such a device is usually metallic and formed for mashing any lumps to a significantly reduced size. The crushing means, which is rotatably mounted in a rather flexible manner through the usage of chain supports, which extend in equilateral directions turns by gravity with respect to its suspension means through the rotation of the inner cylinder which is subjected to turning by means of an external drive means, such as a motor. The flexibility and support of the crushing means by means of the chain suspension means provides for some play in the turning of the crusher during its functioning so that the lumps of material and any other extraneous material accumulated within the drum can be gradually shifted to the vicinity of the crusher and forced under that segment of the crushing means that is arranged longitudinally in proximity and aligned with the contiguous surface of the inner cylinder. The materials as reduced to smaller pieces then exits the first compartment in the inner cylinder and is transported to an attrition chamber immediately adjacent the first compartment of the inner cylinder, where said attrition chamber, having at least a partially perforated cylinder wall, provides high tumbling action to further reduce the size of the remaining lump pieces so as to attain a pass of the granular material through the perforations to further the reduction and transfer of the pieces of particulate matter for collection. The attrition chamber may have blades or spikes or the like to assist in reducing the pieces of material to particulate matter, a substantial portion of which passes through the perforations of the inner cylinder of the attrition chamber.

The particulate matter passing through the perforations from the attrition chamber passes into the space between the inner cylinder and the outer cylinder. The space between the inner cylinder and the outer cylinder is provided with a conveying vane which moves the particulate matter longitudinally in the desired direction, depending upon the direction of orientation of said vanes. The conveyor vane may be installed to allow the material to move forward toward the intake compartment, or in the opposite direction. In the illustrated embodiment of the present invention, the reduced particulate matter moves forward to a screen where the matter is classified, the smaller material falling through for collection, while the larger matter failing to pass through the screen is recycled back into the intake compartment. The classification screen may consist of a metal sheet with perforations, or a multiplicity of sheets or screens of varying sizes, or one or more stainless steel screens, so as to separate and reclassify the particulate matter into more than one size.

The material which did not pass through the perforations in the attrition chamber continues through the attrition chamber and eventually leaves through an exit provided for debris.

The rotary lump crusher/reclaimer of the present invention is disposed substantially horizontally to permit rotation. A base means supports the drum and provides a drive means for driving the drum at the desired speed of rotation.

DETAILED DESCRIPTION OF THE INVENTION

Figure 1:
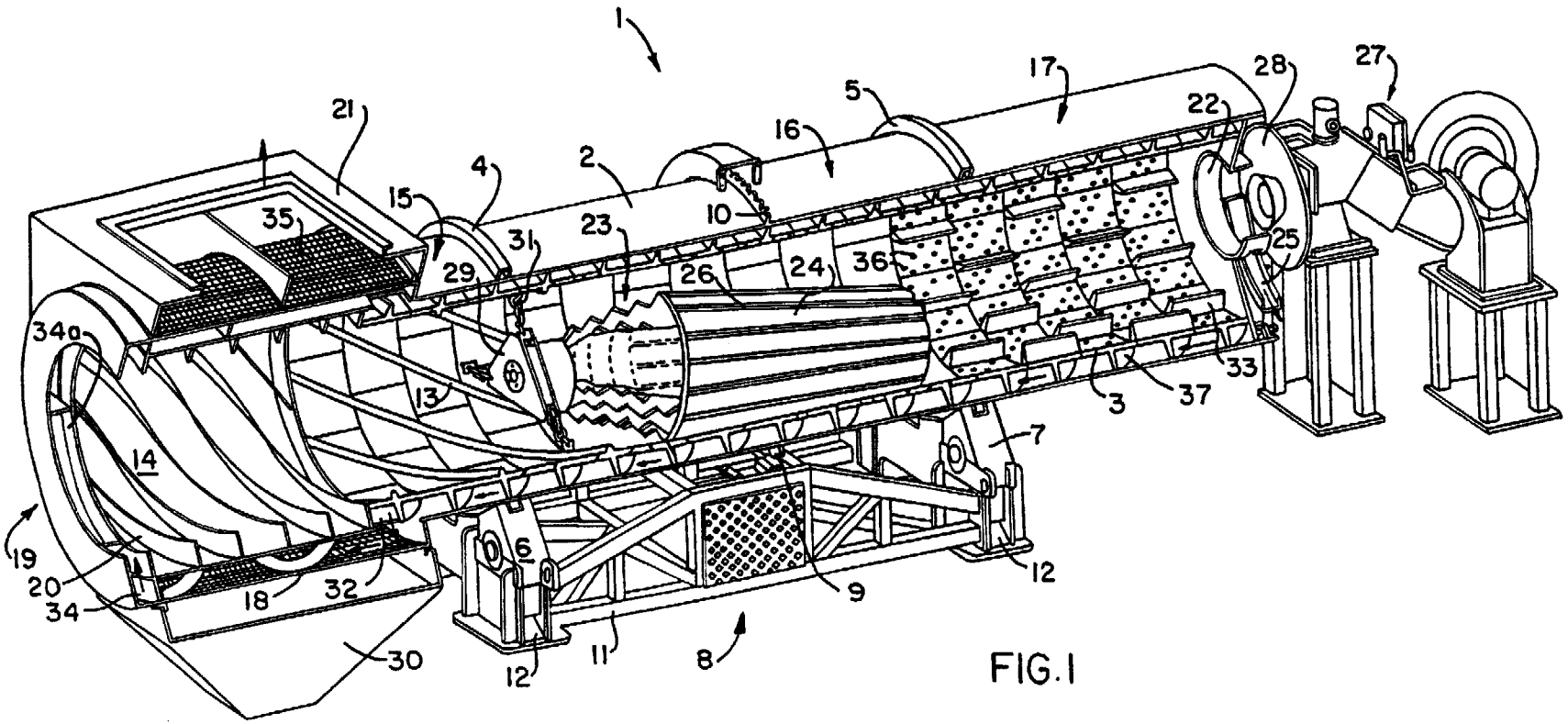
FIG. 1 is an isometric and partial sectional view of one embodiment of a rotary lump crusher/media reclaimer of the present invention.

With respect to FIG. 1, a rotary lump crusher/reclaimer drum 1 is provided with an outer cylinder 2 and an inner cylinder 3. The outer cylinder is provided with an intake compartment 14 wherein lump material, to be processed, is placed into the rotary material crushing drum 1. The intake compartment 14 contains helical vanes 20 which are of sufficiently high profile to enable large clumps and lumps of material to be initially separated into smaller lumps of material which are somewhat uniformly distributed on the inner surface of the intake compartment 14. The intake compartment 14 which has received material through the intake area 19, the latter of which comprises an opening in the end of the rotary drum 1, conveys the material by the helical vanes 20 forward into the first compartment 15 whereupon the material is further handled by helical vanes or rifling 13. The first compartment 15 and the adjacent compartment 16 contain the feeding section with the helical vanes 13 and a crushing and grinding means 23 respectively. The crushing and grinding means 23, incorporating serrated shaped means, is anchored in the compartment 16 by a suspension means 29 having chains fastened to the inner wall of the compartment. The crushing means 23 is substantially cylindrically shaped, albeit formed as a tapered cylinder having longitudinal ribs 26, that extend along the length of the segments of crusher 24. The crushing means 23 is generally a heavy metallic drum-like entity rotatably mounted to a suspension means 29, which functions as a bearing, and which permits the crushing means 23 to rotate by gravity due to the rotation of the cylinders. As rotation occurs, the lump material passes along the first compartment thus entrapping lump material beneath the crusher so as to squash and substantially reduce in size the lump material due to the shape, weight and extensive length of the crushing means 23.

The crushed material, reduced in size, is passed to the attrition chamber 17. The attrition chamber 17 contains apertures 36 in the inner cylinder wall which permit material sufficiently small in size to be classified to pass through the apertures 36. In addition, the attrition chamber 17 contains blades 33 which assist in further reducing the size of the crushed material received in the attrition chamber 17 from the crushing means 23. The blades lift and drop the granular and lump material. Any material which is not reduced to a size sufficient to pass through the apertures 36, exits through an opening for debris, as at 22, whereby the debris is deposited on an exit chute 25.

The particulate matter which passes through the apertures 36 is deposited in the space between the outer cylinder 32 and the inner cylinder 33. Within the space is a continuing conveyor means in the form of helical vanes 37 which sweep the material forwardly toward the intake compartment 14. The material exits at an exit port 32 onto a screen 35. The screen forms the outer portion of the intake compartment. Helical vanes 18 are located between the screen 35 and the surface of the intake compartment 14. The helical vanes 18 sweep the surface of the screen 35 to direct the particulate matter too large to pass through the screen in the direction of the material pick-up port 34. Thus, the coarse material is recycled by means of the exit port 34 into the intake compartment 14. The material which passes through the screen 35, is deposited in the particulate matter collector 30. Located above the intake compartment 14 is a dust collector 21. The dust collector does not rotate as part of the rotary media drum nor does the particulate matter collector 30.

The outer cylinder 2 incorporates upon its external surface, a pair of spaced apart guides, tracks or races as at 4 and 5, which are positioned for riding or sliding upon roller bearings or guides such as can be seen at 6 and 7, the bearings being provided at either side of the apparatus and formed into the base means 8. The base means 8 supports the cylinder 2 and the entire apparatus 1 for rotation. A drive means, such as a motor, as at 9, is provided for cooperating with a sprocket 10 through any suitable inner-connecting gearing means as necessary in order to provide for a controlled rotation of the outer cylinder 2 and its internally arranged components at a controlled speed generally within a range of 1 to 10 rpm. The base means 8 is formed of a series of struts as at 11 and generally is designed to be mounted upon shock absorbers such as 12 in order to dampen vibrations and to lessen the noise of operation of the apparatus.

The outer cylinder 2 extends substantially the entire length of the apparatus with the exception that at the outlet end, as at the chute 25. The chute is not in rotation and is designed for stationary mounting. At the exit end where the chute 25 is located, is an optional mechanism consisting of a burner 27 and a fan 28. The burner 27 provides heat which is transmitted by the fan 28 into the exit way 22 and counter to the direction of the movement of the material in the inner cylinder 3. The heat progresses through the material and assists in drying the particulate matter during its separation.

The outer cylinder 2 and the inner cylinder 3 are affixed to each other so as to rotate simultanteously as the rotation of the rotary lump crusher/reclaimer drum is effected. Certain optional modifications may be made to the inner cylinder. For instance, in the intake compartment 14, apertures could be placed through its wall so that material small enough to be removed from the process at the beginning, could pass through the wall and to the screen 35. Similarly, in compartment 15, the inner cylinder could be provided with perforations to allow particulate matter to pass through into the region between the outer cylinder 2 and the inner cylinder 3 whereupon the matter would be transferred, as discussed earlier, onto the classifying screen 35.

To carry out the process of the invention, lump material is fed into the intake compartment 14 by a load hopper or vibratory conveyor not shown in the drawing. Upon entrance of the material into the intake compartment, the lumps are regulated against surges because of the larger diameter of the intake compartment than any other portion of the apparatus where the inner cylinder 3 is present. The lump material is metered into the crushing compartment 16 by a combination of the high profile segmented helical flights 20 in the intake compartment and the continuous helical vanes or ribs 13 in the first compartment 15. The crushing roller 23 provides positive action to reduce large lumps that vary in size and hardness. The crushing means 23 is of substantial length and includes a segment having a significant length as at crusher 24 which is generally arranged in contiguity with the bottom surface to the inner cylinder 3 and which may include a series of longitudinal-like ribs 26 so that material fed into this region will be substantially ground by means of the heavy weight of the roller to a much finer size. This crushing means revolves by gravity during rotation of the cylinder. The entrance end of the crushing means includes a suspension means 29 as can be noted for pivotal rotation within the inner cylinder 3 as a result of the rotation of the inner cylinder 3 during operations of the apparatus. The suspension means 29 has an integral bearing to permit the rotation of the roller at a different speed from that of the inner cylinder. A suspension means 29 incorporates a housing generally configured in a triangulated or other shape and has linked to it at its apexes a flexible connecting and suspension means such as the shown chains 31. The chains 31 are secured by means of connectors to isolated and reinforced parts of the inner cylinder 3 in order to suspend the upper pivotal end of the crushing means 23 approximately centrally but yet flexible in its mounting in the apparatus. In this manner, little interference is provided against movement of the lump material by means of the conveyor vane 13 into the vicinity of the crushing compartment 16. The lump material that passes through the lump crushing compartment 16 is reduced by means of the serrated crushing means 23 to a size which generally is then reduced in the attrition chamber to less than the size of the apertures in the attrition chamber 17. The crushing section provides a positive action in reducing large lumps to a much smaller size through the action of the crushing ribs 26. Following the foregoing procedure, the ground material is once again forced by the volume of additionally fed material or perhaps through a slight incline in the arrangement of the inner cylinder 3 into the region of the attrition chamber 16 where further particle reducion takes place. At this location, the inner cylinder 3 is perforated and those particle sizes, generally less than ¾ inch and smaller, pass into the spacing intermediate, the outer cylinder 2, and the inner cylinder 3 and are moved by means of the continuous vane 37 further longitudinally along the apparatus returning in the direction of the intake compartment. That material, greater in size than the size of the apertures 36, is lifted by means of the blades 33 and then dropped onto the surface of the inner cylinder for further breakage. If too many of the oversized particles accumulate in the attrition chamber 17, then when the depth is sufficient, the oversized material accumulates and is eventually removed through the debris exit 22 onto the chute for debris 25 which discharges the debris from the apparatus.

The screening section 35 utilizes punched plate or woven wire screen with openings to meet application specifications. The material is classified through a single or multiple screening system that automatically recirculates pieces that are larger than the specifications through the material pick-up exit 34. Apertures are provided through the wall **34*a*** to allow the material to be returned. If desired, when the material is conveyed forward and fails to pass through the screen, it can be directed through a ball mill for further reduction and then returned to the process.

A dust collection hood 21 encloses the screening section in which a controlled velocity of air removes fines and classifies the material.

The rotation speed of the rotary lump crusher/reclaimer of the present invention is usually from about 1 to about 10 rpm, preferably from about 4 to about 10 rpm depending on the particular application. The drum also can be set up to run on a batch type basis.

As can also be seen for this application, the various sections of the inner cylinder may be fabricated of segmented components, as can be seen in our previous patents, and which are incorporated herein by reference, wherein the segments of the inner cylinder may be formed of a rectangular but arcuate shape, having a segment of a rib 13 integrally formed therewith, and likewise having a segment of a vane 37 formed therewith so that when the sections are fabricated, through their interconnecting together as explained in the prior art, they form the uniform inner cylinder 3 of this rotary lump crusher drum.

Special features include crushing, tumbling, scrubbing, screening and classifying in the one self-contained unit. Automatic screening recirculation and automatic debris removal or metallic discharge means are also provided and for which no operator is required. The inner cylinder of the structure may be at least partially formed of liner segments, as explained, such as showing in our previous patents.

Variations or modifications to the structure and operations of the apparatus of the present invention or any of its component parts may occur to those skilled in the art when reviewing the subject matter of this disclosure. Such variations or modifications within the spirit of this invention are intended to be encompassed within the scope of the claims appended hereto. The description of the preferred embodiment set forth herein is solely for illustrative purposes.

We claim:

1. A rotary crusher/reclaimer drum for reclaiming and reclassifying sand and related aggregates from lump materials, said drum being substantially horizontally disposed for rotation for reclaiming lump materials, which comprises an inner cylinder having a first end and a second end, said inner cylinder forming a first chamber, a crushing chamber, and an attrition chamber, along its length, and concentric with said inner cylinder an outer cylinder which extends beyond the inner cylinder at the first end of the inner cylinder to form an intake compartment, the intake compartment being of larger diameter to receive the lump material and having high profile segmented helical flight to advance the lump material without substantial surges into the first compartment of the inner cylinder, said intake compartment having a diameter larger than the diameter of the inner cylinder, said first compartment of the inner cylinder containing means for breaking the lump material into smaller pieces and means to advance the smaller pieces into the crushing chamber where the lump material is crushed into further smaller pieces, the smaller pieces of lump material passing into the attrition chamber, said attrition chamber having at least a partially perforated cylinder wall where high tumbling action further reduces the size of the pieces to particulate matter so as to pass a substantial portion of the material through its perforations, said inner cylinder at its back end having a debris exit, said debris exit being of smaller diameter than the diameter of the inner cylinder, any material not passing through the perforations of the attrition chamber leaving the attrition chamber through the debris exit, a conveying vane provided intermediate the inner and outer cylinder for movement longitudinally of any particular matter deposited therein, a screen surrounding the intake chamber, and said particulate matter moved by the conveying vane being deposited onto the screen for further classification of the particular matter, the matter remaining on the screen being recycled back into the intake compartment, a base incorporating drive means supporting the drum and driving the drum in rotation, a lump crusher provided within the crushing chamber, the lump crusher comprising a length of weighted material forming a crushing means and disposed for partially resting upon the inner surface of the inner cylinder, the crushing means being urged into rotation by the turning of the inner cylinder of the rotary reclaiming drum, one end of the crushing means pivotally suspended approximately centrally of the inner cylinder, suspension means pivotally holding the one end of the crushing means to the inner cylinder, the suspension means including a series of flexible links supporting the one end of the crushing means within the inner cylinder.

2. The rotary crusher/reclaimer drum of claim 1 wherein the diameter of the intake compartment is at least ten percent larger than the diameter of the inner cylinder.

3. The rotary crusher/reclaimer drum of claim 1 wherein the diameter of the intake compartment is approximately the diameter of the outer cylinder.

4. The rotary crusher/reclaimer drum of claim 1 wherein the flexible links are chains.

5. The rotary crusher/reclaimer drum of claim 1 wherein at least a part of the inner cylinder is formed of interlocking liner segments.

* * * * *